US008122678B2

(12) United States Patent
Pulver

(10) Patent No.: US 8,122,678 B2
(45) Date of Patent: Feb. 28, 2012

(54) SPIN HARDWARE FOR STRUCTURAL FRAME MEMBERS

(76) Inventor: Timothy William Pulver, Marietta, GA (US)

( * ) Notice: Subject to any disclaimer, the term of this patent is extended or adjusted under 35 U.S.C. 154(b) by 214 days.

(21) Appl. No.: 12/378,538

(22) Filed: Feb. 17, 2009

(65) Prior Publication Data

US 2009/0205265 A1 Aug. 20, 2009

Related U.S. Application Data

(60) Provisional application No. 61/065,957, filed on Feb. 19, 2008.

(51) Int. Cl.
*E04B 1/00* (2006.01)

(52) U.S. Cl. ..... 52/745.11; 52/65; 52/749.1; 160/195; 248/349.1

(58) Field of Classification Search ..... 52/65, 64, 52/66–71, 223.13, 745.11, 749.1; 160/195; 248/349.1; 414/223.01
See application file for complete search history.

(56) References Cited

U.S. PATENT DOCUMENTS

| | | | | |
|---|---|---|---|---|
| 2,564,485 | A | 8/1951 | Kurstin et al. | |
| 2,712,974 | A | 7/1955 | Renna | |
| 2,823,425 | A | 2/1958 | Granek | |
| 3,293,632 | A | 12/1966 | Blume | |
| 3,645,053 | A | 2/1972 | Taggart | |
| 3,933,400 | A | 1/1976 | Helgeson | |
| 4,571,900 | A | 2/1986 | Kelman | |
| 4,631,894 | A | 12/1986 | Jerila | |
| 5,079,879 | A * | 1/1992 | Rodriguez | 52/223.13 |
| 5,259,685 | A | 11/1993 | Gilb | |
| 5,331,695 | A | 7/1994 | Bales | |
| 5,399,044 | A | 3/1995 | Gilb | |
| 5,553,961 | A | 9/1996 | Olden | |
| 5,603,580 | A | 2/1997 | Leek et al. | |
| 6,148,568 | A * | 11/2000 | Beasley | 52/65 |
| 6,401,422 | B1 | 6/2002 | Olden | |
| 6,422,287 | B1 | 7/2002 | Wilke | |
| 6,430,887 | B1 | 8/2002 | Daudet | |
| 6,615,556 | B2 | 9/2003 | Cates et al. | |
| 6,766,562 | B1 | 7/2004 | Horn | |
| 6,996,940 | B2 | 2/2006 | Beasley | |
| 2002/0038952 | A1 * | 4/2002 | Wolff | 285/24 |

FOREIGN PATENT DOCUMENTS

WO WO 2007/012196 A1 2/2007

OTHER PUBLICATIONS

Ruth Ryon, "Wall-to-Wall Ingenuity", Los Angeles Times, Jun. 24, 2001, Real Estate section of newspaper, Los Angeles, CA, USA.

* cited by examiner

*Primary Examiner* — William Gilbert
(74) *Attorney, Agent, or Firm* — Thomas, Kayden, Horstemeyer & Risley, LLP

(57) ABSTRACT

A multi-component spin hardware is provided for connecting structural framing members to other structural framing members while allowing desired portions of the framing members to pivot, selectively displacing the framing members to variable positions. The spin hardware generally includes a top bracket, bottom bracket and counter bracket assembly. The spin hardware bracket assemblies can be installed along a vertical axis in infinite locations providing maximum flexibility and creativity while connecting structural framing members in infinite configurations.

20 Claims, 10 Drawing Sheets

SPIN HARDWARE FOR STRUCTURAL FRAME MEMBERS

CROSS-REFERENCE TO RELATED APPLICATIONS

This application claims priority to, and the benefit of, U.S. Provisional Application No. 61/065,957, entitled "Spin Hardware," which was filed on Feb. 19, 2008.

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF THE INVENTION

This invention relates to pivoting metal connection hardware for rigidly joining wood or metal structural framing members but with framing members being pivotable allowing selective displacement of framing members to variable positions.

The general concept of pivoting hardware is known in the art in the form of door hardware, revolving doors, rotating door structures, rotatable structures, revolving wall systems and panels, revolving modules and packages, furniture systems, hinge assemblies, and hinged joints for structural frame systems. In addition, rigid connection hardware is known in the art in the form of rigid intersection connectors.

Concepts of pivoting hardware are frequently depicted in large complicated systems that are very expensive, are not premanufactured, nor readily available to the public for purchase, and require a high level of knowledge and ability of a person skilled in the art to install these systems.

A variety of pivoting hardware is presented in the prior art:

U.S. Pat. No. 2,564,485 to Kurstin discloses a revolving door and cabinet with a swivel ball-bearing structure.

U.S. Pat. No. 2,712,974 to Renna discloses a multiple-purpose door structure with upper and lower seated bearing members.

U.S. Pat. No. 2,823,425 to Granek discloses rotatable sections for buildings with a central pipe and recessed bearing race.

U.S. Pat. No. 3,293,632 to Blume discloses a reversible wall panel with a vertical hollow shaft with upper and lower thrust and guide bearings.

U.S. Pat. No. 3,645,053 to Taggart discloses a swivel-sectioned building wall with a vertical central post with upper and lower thrust bearings.

U.S. Pat. No. 3,933,400 to Helgeson discloses a revolving kitchen package with nested concentric rings allowing for frictionally rotational movement.

U.S. Pat. No. 4,571,900 to Kelman discloses a vertical central core with rotating ring members.

U.S. Pat. No. 4,631,894 to Jerila discloses hardware for panel doors with upper and lower spring-loaded pivots in pivot brackets.

U.S. Pat. No. 5,259,685 to Gilb discloses a rigid connector for readily constructing framed structures with rigid intersection connections.

U.S. Pat. No. 5,331,695 to Bales discloses a pivot bearing for wood frame wall bed systems with a horizontal pivot bearing system.

U.S. Pat. No. 5,399,044 to Gilb discloses a rigid connector for readily constructing framed structures with rigid intersection connections.

U.S. Pat. No. 5,553,961 to Olden discloses a hinge and hinge joint for hingedly connecting structural frame members of wooden roof trusses.

U.S. Pat. No. 5,603,580 to Leek discloses a positive angle fastening device for constructing framed structures with rigid connections.

U.S. Pat. No. 6,401,422 to Olden discloses a hinge and hinge joint for structural members for the interconnection of disconnected truss members.

U.S. Pat. No. 6,422,287 to Wilke discloses a slide/swing patio door with pivot hardware.

U.S. Pat. No. 6,430,887 to Daudet discloses a hinge assembly for a truss with pivot hardware.

U.S. Pat. No. 6,615,556 to Cates discloses a frameless door assembly for cleanrooms with stud connection hardware.

U.S. Pat. No. 6,766,562 to Horn discloses an extendible hinge with pivot hardware for door assemblies.

U.S. Pat. No. 6,996,940 B2 to Beasley discloses a movable wall module with a broad area bearing assembly.

International Pat. No. WO 2007/012196 A1 to Vermeulen discloses a mounted rotatable television unit with a premanufactured pivoting frame system with a vertical post and sleeves.

Although the prior art pivot hardware rotates doors, panels, systems, modules, and structures, none of the prior art pivot hardware allows a simple and practical way of connecting conventional wood or metal structural framing members to allow pivotable selective displacement of desired framing members to variable positions.

The prior art pivot hardware fails to allow flexibility for the hardware to be used by a person skilled in the art of structural framing to incorporate spinning or rotating framing members in a variety of applications due to the inflexibility of the prior art to be used in such a manner other than specifically taught.

The present invention is directed to an improved, practical and flexible spin hardware designed for mass production for simple and cost-efficient incorporation into residential or commercial structural framing systems.

The improved spin hardware supports functional uses of rotating structural framing and has a construction compatible with heavy dead and live design loads required in modern building construction and by building codes.

The simple design of the improved spin hardware supports a use by "do-it-yourself" handyman/homeowners and not just persons skilled in the art of building construction, specifically structural framing. The use of any of the pivot hardware prior art by a "do-it-yourself" handyman/homeowner in a manner for the intended use of the improved spin hardware would be non-obvious.

The improved spin hardware is intended to be readily available and sold to the public as "off-the-shelf" hardware, similar to door hinges and other standard building hardware, at local hardware stores.

BRIEF SUMMARY OF THE INVENTION

The present invention is a multi-component spin hardware kit for installing structural framing members such as dimensioned lumber or cold formed metal framing wherein when installed, normal rigid connections of structural framing members are allowed to pivot within other rigidly connected structural framing members.

The hardware comprises a top component, a bottom component and counter supports.

The top component consists of two brackets that independently attach to different framing members desired to have a freely rotating connection that withstands lateral loads while rotating. The top component must be installed on a vertical axis directly above the bottom component.

The bottom component consists of two brackets that independently attach to different framing members desired to have a freely rotating connection that withstands lateral loads. An industrial bearing placed between the two brackets allows the bottom component to withstand substantial vertical dead and live loads while still allowing the connection to freely rotate. The bottom component must be installed on a vertical axis directly below the top component.

The counter supports are an accessory bracket to the spin hardware and do not need to be installed with the top and bottom components; they are included with the other components to provide a complete hardware kit for one of the preferred forms of the invention where a countertop is installed attached to rotating structural framing members.

The top and bottom components are specifically sized to flexibly work with standard sizes of dimensioned lumber and cold form metal framing in multiple structural framed layouts and designs, overcoming the pre-existing problems found within prior art.

Further features of the invention will be described or will become apparent in the course of the following detailed description.

DETAILED DESCRIPTION OF THE INVENTION

Figures 1, 2:
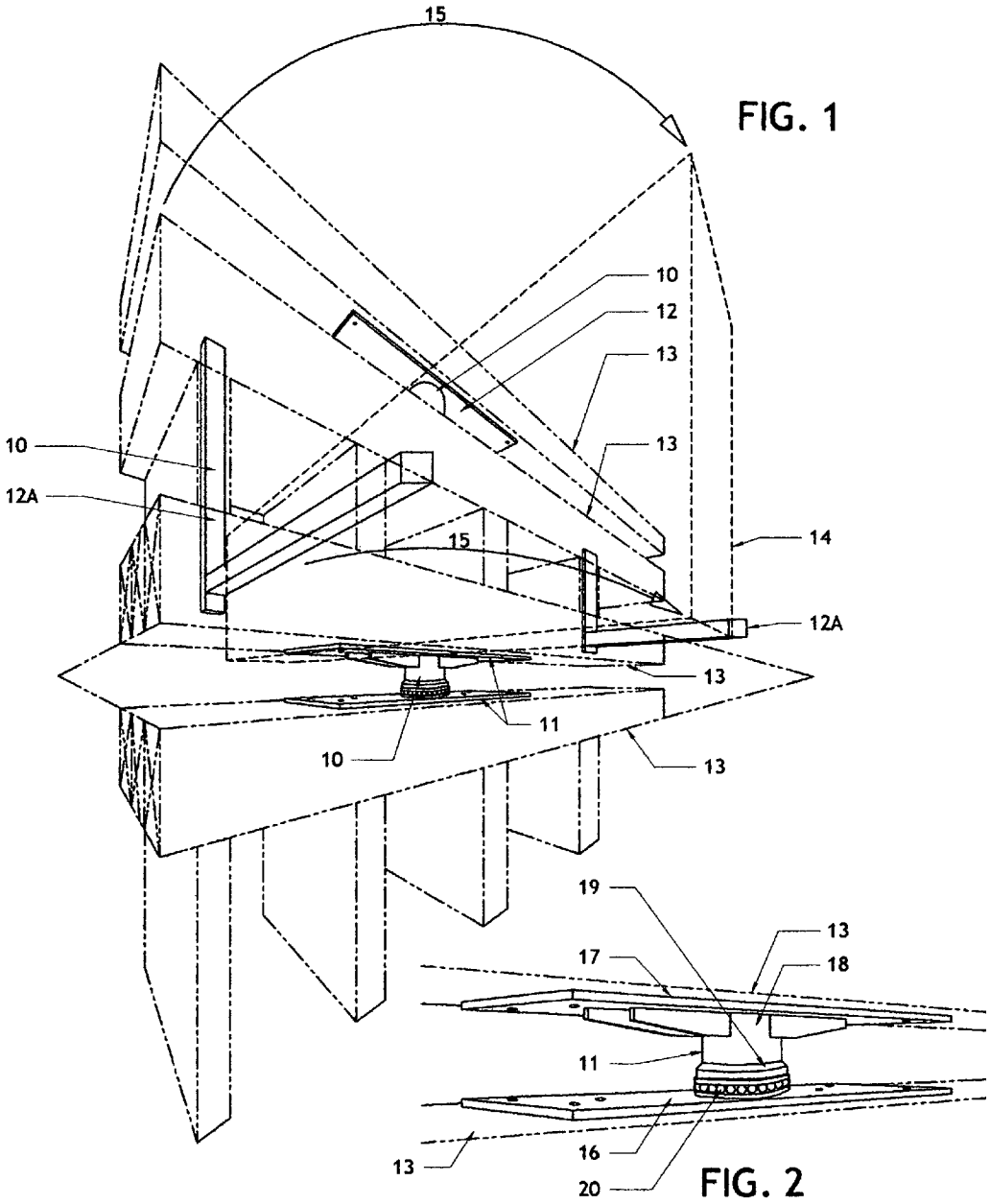
FIG. 1 is a perspective view of multiple structural framing members connected by the spin hardware of the present invention illustrating the selective displacement of the portion of the framing desired to pivot.
FIG. 2 is an enlarged perspective view of the bottom component of the spin hardware illustrated in FIG. 1 showing the steel plates, pipe and bearing.

The present invention provides metal connection spin hardware which allows rigid structural framing members to pivot within other rigid structural framing members. Referring now to the figures, where numerals represent various elements of the present invention, the spin hardware is generally illustrated in FIG. 1.

The spin hardware 10 generally consists of precision welded steel bottom brackets 11, top brackets 12 and counter brackets 12A, where a counter or credenza will be used. All bracket components are high grade ASO steel. The spin hardware 10 attaches to structural framing members 13 which allow desired portions of the structural framing members 14 to rotate 15.

The bottom bracket assembly 11 is generally illustrated in FIG. 2 attaching to the horizontal planar surfaces of structural framing members 13. The bottom bracket assembly 11 consists of a bottom-bottom bracket 16 and a bottom-top bracket 17 where the bottom-top bracket 17 is placed on top of the bottom-bottom bracket 16 in such a manner that the pipe sleeve 18 of the bottom-top bracket 17 fits over the pipe sleeve of the bottom-bottom bracket 16. The belled flange 19 of the bottom-top pipe sleeve 18 bears on top of a pre-manufactured industrial bearing 20 that bears on the top surface of the steel plate of the bottom-bottom bracket 16.

Figure 5:
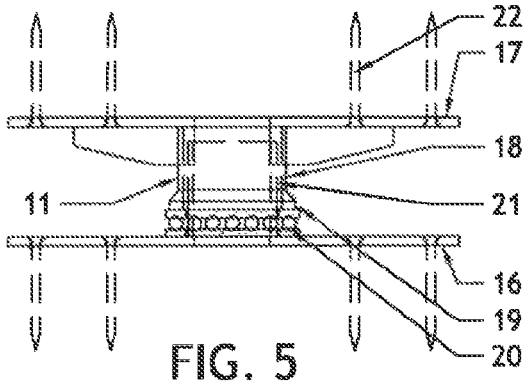
FIG. 5 is a front elevation view of the bottom component of the spin hardware illustrated in FIG. 1 illustrating one preferred form of the setting a pre-determined clearance for the installation of wood trim boards to conceal the spin hardware.
Figure 24:
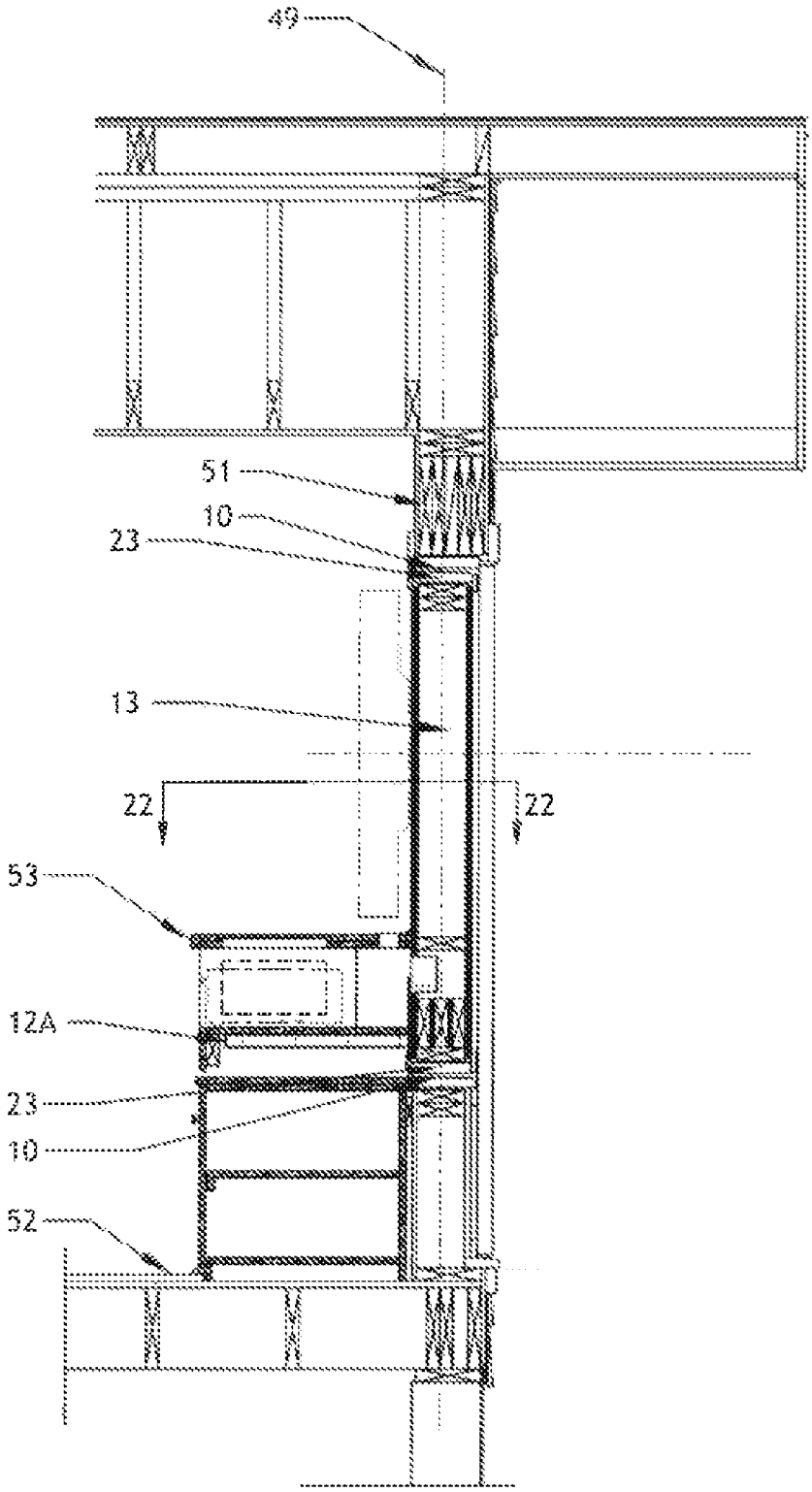
FIG. 24 is a vertical sectional view illustrating one preferred form of the invention illustrated in FIG. 22.

A front elevation view of the bottom bracket assembly 11 is generally illustrated in FIG. 5. The slight air space/clearance 21 between the inside surface of the bottom-top pipe sleeve 18 and the outside surface of the bottom-bottom pipe sleeve allows the bottom-top bracket 17 to spin/rotate freely about the bottom-bottom bracket 16. The spin/rotation movement occurs about the vertical axis centered on the bottom-bottom bracket 16, the bottom-bottom bracket's pipe sleeve, and the industrial bearing 20. The overlapping pipe sleeves of the bottom-top bracket 17 and bottom-bottom bracket 16 prevent the two brackets of the bottom bracket 11 assembly from slipping or shifting horizontally from each other, stabilizing the brackets during the spin/rotation movement. Screws 22 are used to attach the brackets to the structural framing. The clearance between the bottom-bottom bracket's 16 horizontal plate and the bottom-top bracket's 17 horizontal plate is 3⅜", allowing for shimmed wood trim 23 to conceal the bottom bracket assembly 11 while maintaining ½" clearance between the wood trim 23. FIG. 24 illustrates the wood trim 23.

Figure 6:
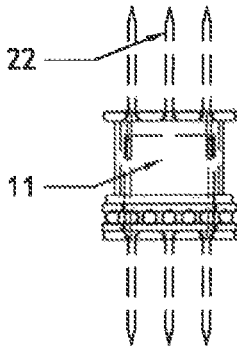
FIG. 6 is an end elevation view of the spin hardware illustrated in FIG. 5.

An end elevation view of the bottom bracket assembly 11 is generally illustrated in FIG. 6 with an end view of the attachment screws 22.

Figure 3:
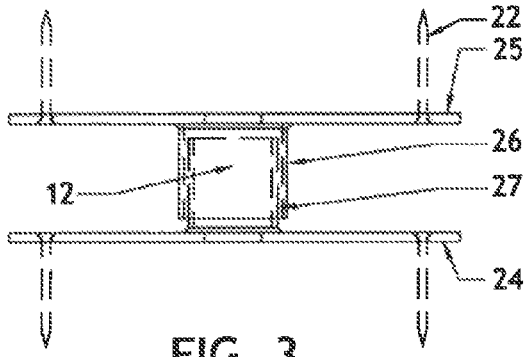
FIG. 3 is a front elevation view of the top component of the spin hardware illustrated in FIG. 1 illustrating one preferred form of the invention setting a pre-determined clearance for the installation of wood trim boards to conceal the spin hardware.

A front elevation of the top bracket assembly 12 is generally illustrated in FIG. 3. The top bracket assembly 12 consists of a top-bottom bracket 24 and a top-top bracket 25 where the top-top bracket 25 is placed on top of the top-bottom bracket 24 in such a manner that the pipe sleeve 26 of the top-top bracket 25 fits over the pipe sleeve of the top-bottom bracket 24. The slight air space/clearance 27 between the inside surface of the top-top pipe sleeve 26 and the outside surface of the top-bottom pipe sleeve allows the top-top bracket 25 to spin/rotate freely about the top-bottom bracket 24. The spin/rotation movement occurs about the vertical axis centered on the top-bottom bracket 24 and top-bottom bracket's pipe sleeve. The overlapping pipe sleeves of the top-top bracket 25 and the top-bottom bracket 24 prevent the two brackets of the top bracket assembly 12 from shifting horizontally from each other, stabilizing the brackets during the spin/rotation movement. Screws 22 are used to attach the brackets to the structural framing. The clearance between the top-bottom bracket's 24 horizontal plate and the top-top bracket's 25 horizontal plate is 3⅜", allowing for shimmed wood trim 23 to conceal the bottom bracket assembly 11 while maintaining ½" clearance between the wood trim 23. FIG. 24 illustrates the wood trim 23.

Figure 4:
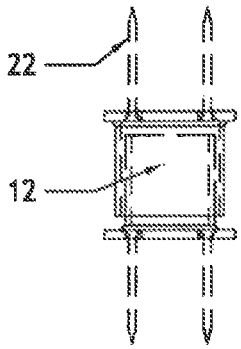
FIG. 4 is an end elevation view of the spin hardware illustrated in FIG. 3.

An end elevation view of the top bracket assembly 12 is generally illustrated in FIG. 4 with an end view of the attachment screws 22.

Figure 7:
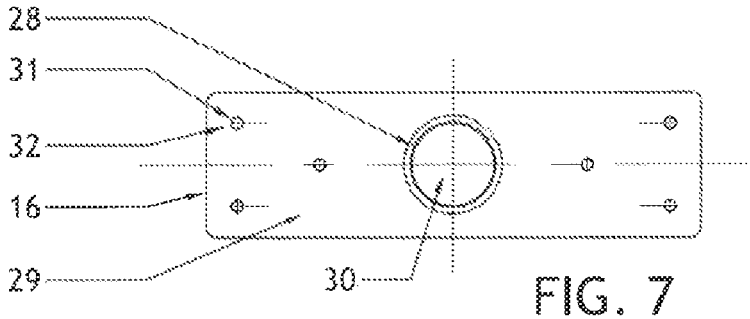
FIG. 7 is a top plan view of the bottom bracket of the bottom component of the spin hardware illustrated in FIG. 5 illustrating one preferred form of the invention with specific plate openings and fastener opening locations.

A top plan view of the bottom-bottom bracket 16 is illustrated in FIG. 7. The bottom-bottom bracket 16 is made by precision welding a 2" diameter vertical steel pipe 28 to a horizontal ¼" thick steel plate 29 where the exact center of the steel pipe 28 is centered in the exact middle/center of the steel plate 29 and centered on a 2" diameter pre-drilled hole 30 in the exact middle/center of the steel plate 29. All precision welds on the inside and outside of the pipe 28 are ground smooth so as not to interfere with the surface of the industrial bearing 20 lying horizontally flat and adjacent to the top surface of the steel plate 29. Six holes 31 are predrilled and countersunk 32 through the steel plate 29 to allow the bottom-bottom bracket 16 to be fastened to wood framing components 13 with the heads of the fastening screws 22 being flush with the surface of the steel plate 29. Specific plate 29 and fastener opening 31 locations are shown.

Figure 8:
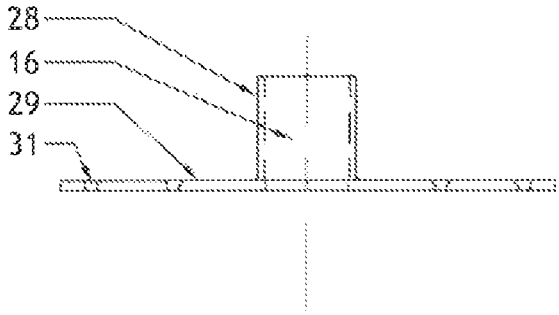
FIG. 8 is a front elevation view of the spin hardware illustrated in FIG. 7.

A front elevation view of the bottom-bottom bracket 16 is illustrated in FIG. 8. The specific height of the vertical steel pipe 28 is indicated as 2½." Specific fastener opening 31 locations are shown.

Figure 9:
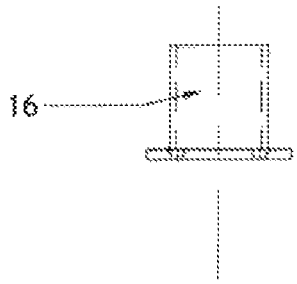
FIG. 9 is an end elevation view of the spin hardware illustrated in FIG. 7.

An end elevation view of the bottom-bottom bracket 16 is illustrated in FIG. 9.

Figure 10:
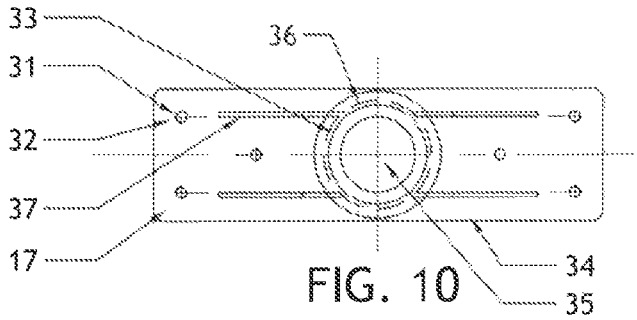
FIG. 10 is a bottom plan view of the top bracket of the bottom component of the spin hardware illustrated in FIG. 5 illustrating one preferred form of the invention with specific belled flange, optional gusset plates, plate openings and fastener opening locations.

A bottom plan view of the bottom-top bracket 17 is illustrated in FIG. 10. The bottom-top bracket 17 is made by precision welding a 2½" diameter vertical steel pipe 33 to a horizontal ¼" thick steel plate 34 where the exact center of the steel pipe 33 is centered in the exact middle/center of the steel plate 34 and centered on a 2" diameter pre-drilled hole 35 in the exact middle/center of the steel plate 34. Prior to welding the steel pipe 33 to the steel plate 34, the bottom of the pipe 33 is precision machined to provide a belled flange 36 with a perfectly flat horizontal bottom surface. All precision welds on the inside and outside of the pipe 33 are ground smooth. Six holes 31 are pre-drilled and countersunk 32 through the steel plate 34 to allow the bottom-top bracket 17 to be fastened to wood framing components 13 with the heads of the fastening screws 22 being flush with the surface of the steel plate 34. Optional ⅛" thick steel gusset plates 37 can be welded to the steel plate 34 and steel pipe 33 to provide additional stiffness to the steel plate 34 when the bottom bracket assembly 17 will be carrying dead and live loads over 750 lbs.

Figure 11:
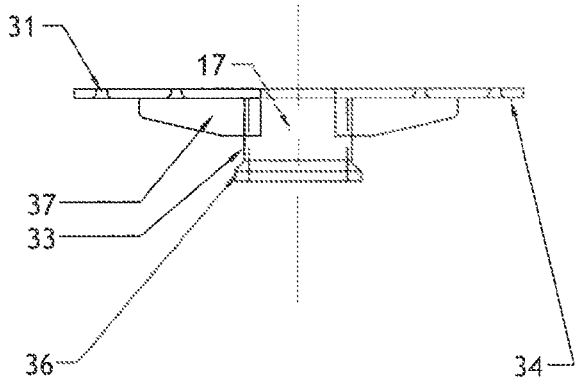
FIG. 11 is a front elevation view of the spin hardware illustrated in FIG. 10.

A front elevation view of the bottom-top bracket 17 is illustrated in FIG. 11. The specific heights of the vertical steel pipe 33 and belled flange 36 are as shown. Specific fastener opening 31 locations are shown. Optional gusset plates 37 are shown.

Figure 12:
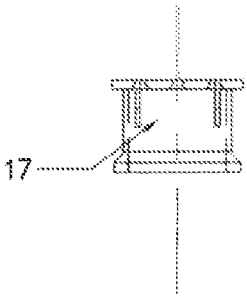
FIG. 12 is an end elevation view of the spin hardware illustrated in FIG. 10.

An end elevation view of the bottom-top bracket 17 is illustrated in FIG. 12.

Figure 13:
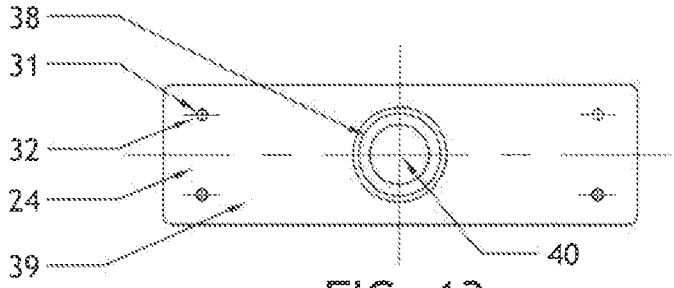
FIG. 13 is a top plan view of the bottom bracket of the top component of the spin hardware illustrated in FIG. 3 illustrating one preferred form of the invention with specific plate openings and fastener opening locations.

A top plan view of the top-bottom bracket 24 is illustrated in FIG. 13. The top-bottom bracket 24 is made by precision welding a 2" diameter vertical steel pipe 38 to a horizontal ¼" thick steel plate 39 where the exact center of the steel pipe 38 is centered in the exact middle/center of the steel plate 39 and centered on a 1½" diameter pre-drilled hole 40 in the exact middle/center of the steel plate 39. All precision welds on the inside and outside of the pipe 38 are ground smooth. Four holes 31 are pre-drilled and countersunk 32 through the steel plate 39 to allow the top-bottom bracket 24 to be fastened to wood framing components 13 with the heads of the fastening screws 22 being flush with the surface of the steel plate 39.

Figure 14:
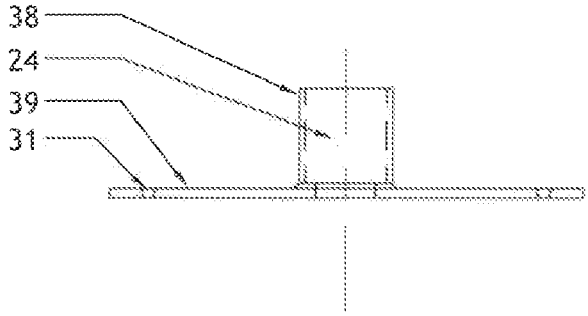
FIG. 14 is a front elevation view of the spin hardware illustrated in FIG. 13.

A front elevation view of the top-bottom bracket 24 is illustrated in FIG. 14. The specific height of the vertical steel pipe 38 is indicated as 2½". Specific fastener opening 31 locations are shown.

Figure 15:
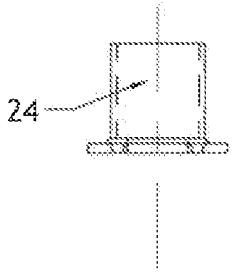
FIG. 15 is an end elevation view of the spin hardware illustrated in FIG. 13

An end elevation view of the top-bottom bracket 24 is illustrated in FIG. 15.

Figure 16:
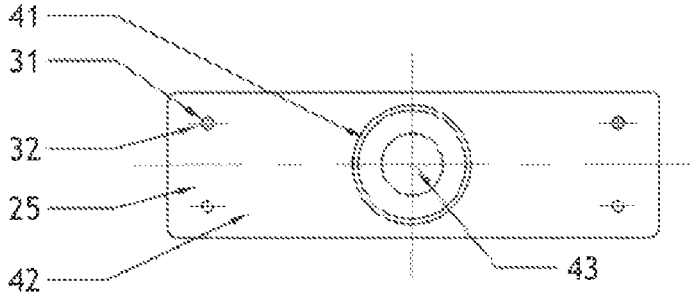
FIG. 16 is a bottom plan view of the top bracket of the top component of the spin hardware illustrated in FIG. 3 illustrating one preferred form of the invention with specific plate openings and fastener opening locations.

A bottom plan view of the top-top bracket 25 is illustrated in FIG. 16. The top-top bracket 25 is made by precision welding a 2½" diameter vertical steel pipe 41 to a horizontal ¼" thick steel plate 43 where the exact center of the steel pipe 41 is centered in the exact middle/center of the steel plate 42 and centered on a 1½" diameter pre-drilled hole 43 in the exact middle/center of the steel plate 42. All precision welds on the inside and outside of the pipe 41 are ground smooth. Four holes 31 are pre-drilled and countersunk 32 through the steel plate 42 to allow the top-top bracket 25 to be fastened to wood framing components 13 with the heads of the fastening screws 22 being flush with surface of the steel plate 42.

Figure 17:
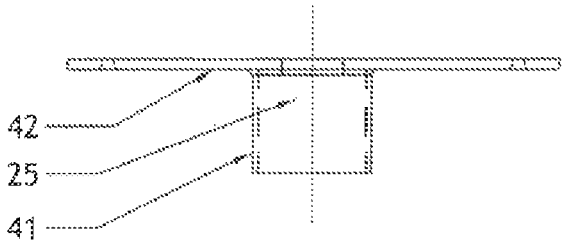
FIG. 17 is a front elevation view of the spin hardware illustrated in FIG. 16.

A front elevation view of the top-top bracket 25 is illustrated in FIG. 17. The specific height of the vertical steel pipe 41 is indicated as 2½". Specific fastener opening 31 locations are shown.

Figure 18:
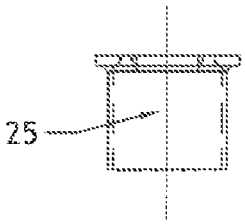
FIG. 18 is an end elevation view of the spin hardware illustrated in FIG. 16.

An end elevation view of the top-top bracket 25 is illustrated in FIG. 18.

Figure 19:
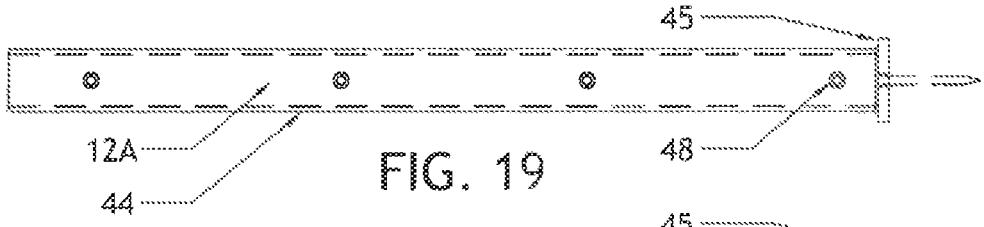
FIG. 19 is a top plan view of the counter bracket component of the spin hardware illustrated in FIG. 1 illustrating one preferred form of the invention with specific fastener opening locations.

A top plan view of the counter bracket 12A is illustrated in FIG. 19. The counter bracket 12A consists of a horizontal steel tube 44 precision welded to a vertical steel plane 45. Multiple counter brackets 12A can be attached to vertical wood framing 13 allowing a countertop or credenza to be attached to and supported by the counter brackets 12A. The counter bracket 12A is made by precision welding a 1½"× 1¼" square horizontal steel tube 44 to a vertical ¼" thick steel plate 45 where the exact center of the steel tube 44 is centered in the exact middle/center of the steel plate 45. All precision welds on the outside of the tube 44 are ground smooth. Four holes 46 are pre-drilled and countersunk 47 through the steel plate 45 to allow the counter bracket 12A to be fastened to wood framing components 13 with the heads of the fastening screws 22 being flush with the surface of the steel plate 45. Four holes 48 are pre~drilled through the steel tube 44 to allow a counter or credenza 53 to be fastened 22 to the counter bracket 12A.

Figure 20:
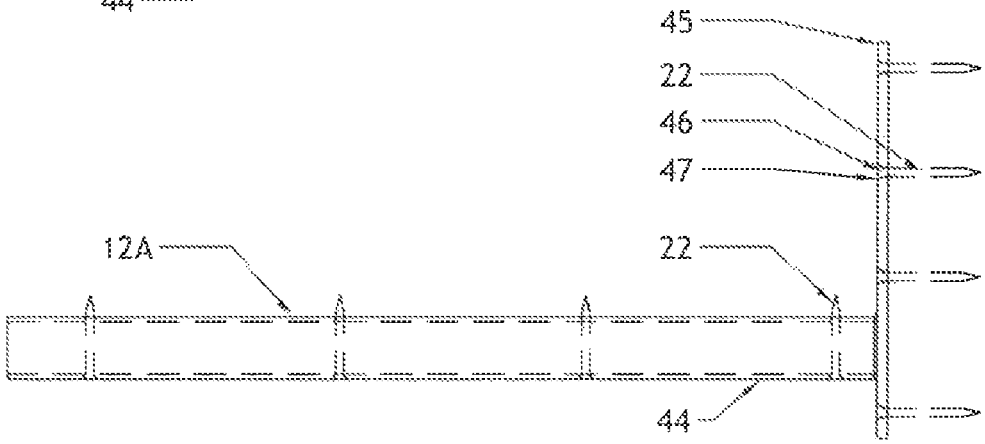
FIG. 20 is a side elevation view of the spin hardware illustrated in FIG. 19.

A side elevation view of the counter bracket 12A is illustrated in FIG. 20. Specific locations of the horizontal steel tube 44 and vertical steel plate 45 are shown. Specific locations of fastener 22 openings 46 and 48, and counter-sunk openings 47 are shown.

Figure 21:
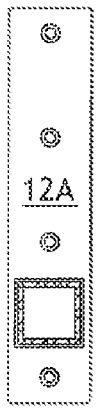
FIG. 21 is an end elevation view of the spin hardware illustrated in FIG. 19.

A front elevation view of the counter bracket 12A is illustrated in FIG. 21.

Figure 22:
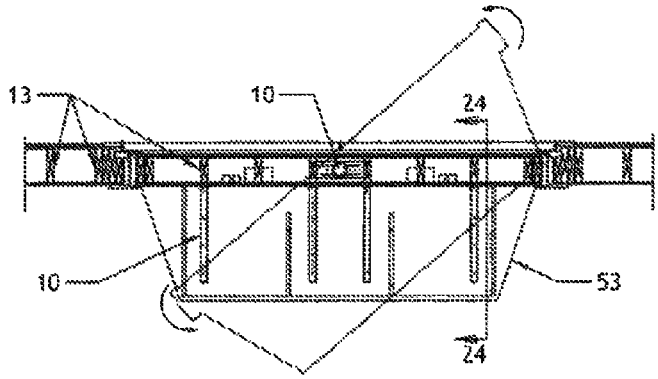
FIG. 22 is a horizontal sectional plan view of the spin hardware illustrated in FIG. 1 illustrating one preferred form of the invention connecting multiple structural framing members of specific locations to the portion of framing desired to pivot of specific locations.
Figure 23:
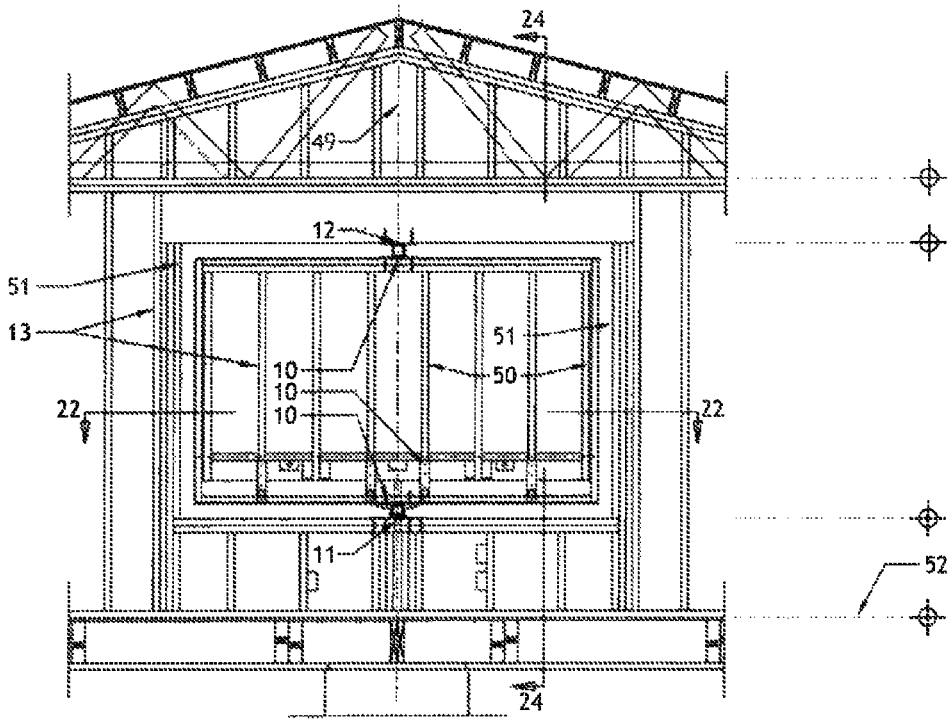
FIG. 23 is a front elevation view of the spin hardware illustrated in FIG. 22.

The preferred form of installing spin hardware 10 is illustrated in FIG. 22, FIG. 23, and FIG. 24. Spin hardware 10 can attach to structural framing 13 where framing components 13 are desired to spin or rotate about other structural framing components 13 where the spin or rotation is about a vertical axis 49, and the spinning or rotating framing components 13 must be securely held in place while supporting structural loads. The minimum width of any structural framing component directly attached to spin hardware 10 would be 3½", the nominal width of a standard 2"×4" dimensioned framing lumber.

A person skilled in the art of using spin hardware 10 would purchase pre-manufactured spin hardware 10 in pre-assembled kits. The top & bottom bracket kit would include the top bracket assembly 12, bottom bracket assembly 11, one pre-packaged industrial bearing 20, and all of the associated screws 22 and washers necessary to install the top & bottom brackets, including installation instructions. The counter bracket 12A kit would include four counter brackets 12A and all of the associated screws 22 and washers necessary to install the counter brackets 12A, including installation instructions.

It is important to note that a person skilled in the art of using spin hardware 10 could be either a contractor, a carpenter, a millwork/cabinet installer, or an average "do-it-yourself" homeowner with the proper tools and abilities to follow the spin hardware instructions.

A front elevation view of the preferred form of installing spin hardware 10 is illustrated in FIG. 23. The top bracket assembly 12 and bottom bracket assembly 11 are installed on a pre-framed component 50 installed into a pre-framed rough opening 51. The top bracket assembly 12 and bottom bracket assembly 11 are installed by screwing the bottom-top bracket 17 to the bottom of a pre-framed framing component 50, and then screwing the top-bottom bracket 24 to the top of the same pre-framed component 50. The top-bottom bracket 24 is located and centered above the bottom-top bracket 17 on the vertical rotating axis 49 of the bottom-top bracket 17. The top-top bracket 25 is placed on top of the installed top-bottom bracket 24. The industrial bearing 20 is placed over the pipe sleeve 28 of the bottom-bottom bracket 16. The bottom-bottom bracket 16 is placed under the bottom-top bracket 17 and is lifted and held in place so the pipe sleeve 28 of the bottom-bottom bracket 16 is inside of the pipe sleeve 33 of the bottom-top bracket 17, with the top surface of the industrial bearing 20 hitting the bottom surface of the belled flange 36. The pre-framed component 50 is slid into the pre-framed rough opening 51. The top-top bracket 25 is attached to the bottom of the pre-framed rough opening component 51 after locating the center of the top-top bracket 25 on the vertical rotating axis 49 of the bottom-top bracket 17. The bottom-bottom bracket 16 is attached to the top of the pre-framed rough opening 51 after locating the center of the bottom-bottom bracket 16 on the vertical rotating axis 49 of the bottom-top bracket 17.

The counter brackets 12A are installed at a desired height from a horizontal floor plane 52 by attaching each individual counter bracket 12A to an individual vertical framing member 13 of a pre-framed component 50 such as a wall. The vertical steel plate 45 of a counter bracket 12A is attached securely into a vertical wood framing member 13 so that the vertical steel plate 45 is plumb and the horizontal steel tube 44 is perpendicular to the vertical wood framing member 13. After enough counter brackets 12A required to support the countertop-credenza 53 have been installed to the pre-framed wood component 50, such as a wall, the countertop/credenza 53 can be placed on top of the horizontal steel tubes 44. Once the countertop/credenza 53 is located as desired, it is attached to the counter brackets 12A by screwing wood screws 22 through the pre-drilled holes 48 in the horizontal steel tubes 44 into the bottom of the countertop/credenza 53.

Figure 25:
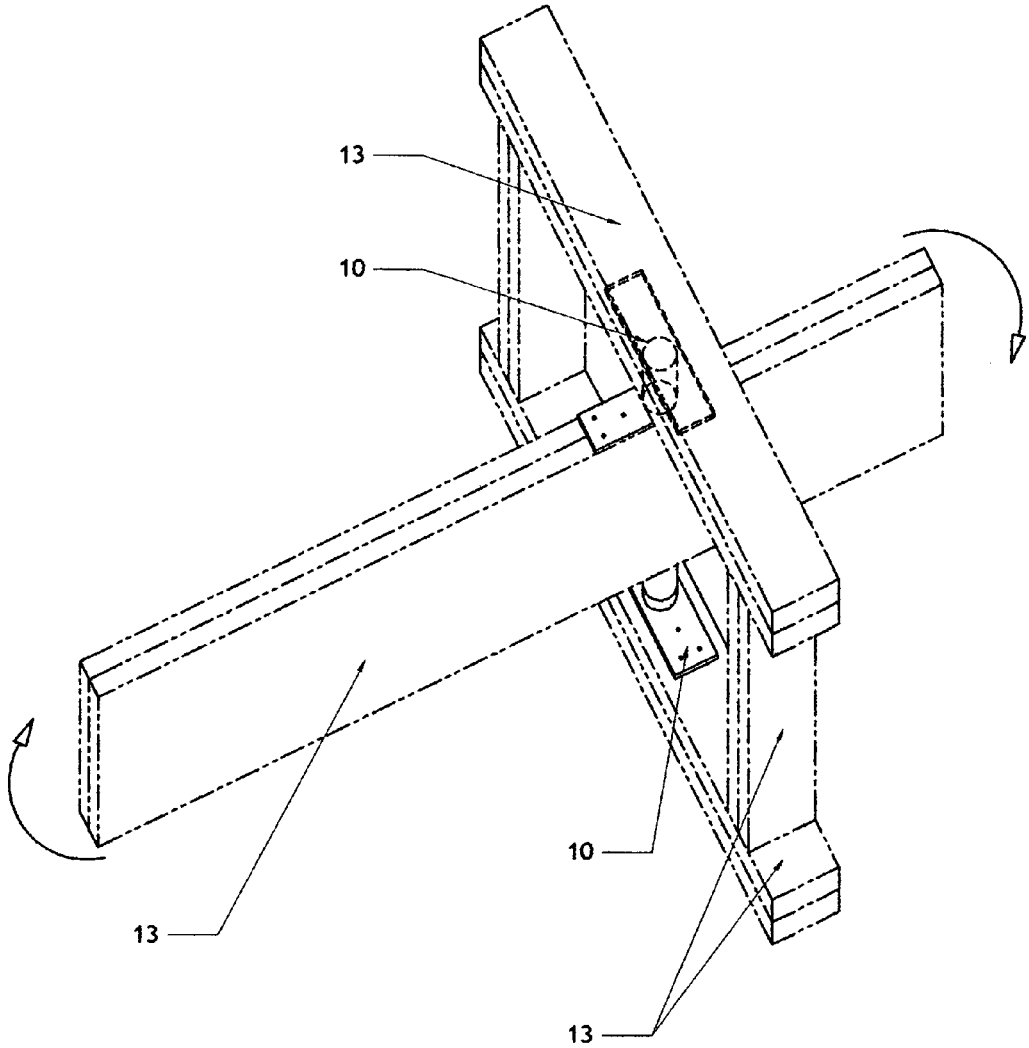
FIG. 25 is an axonometric view illustrating an alternative preferred form of the invention, with a horizontal structural beam framing into a vertical section of structural wall framing, whereas the spin hardware allows the selective displacement of the horizontal beam to variable positions.

As stated previously, it is contemplated that an average "do-it-yourself" homeowner could be the "person skilled in the art" of using spin hardware 10. An average "do-it-yourself" homeowner (or contractor, carpenter, millwork/cabinet installer, etc.) could purchase pre-manufactured spin hardware 10 in pre-assembled kits from easy to purchase locations (local hardware stores or the internet) and could install spin hardware 10 as indicated on FIG. 22 through FIG. 24, or as the "do-it-yourself" homeowner (or contractor, carpenter, millwork/cabinet installer, etc.) so desires using their own creativity and ingenuity based on their own specific alternative needs for spinning or rotating structural framing components 13 about other structural framing components where the spin rotation is about a vertical axis 49, and the spinning or rotating framing components 13 must be securely held in place while supporting structural loads. FIG. 25 illustrates an alternative preferred form of installing spin hardware 10.

What is claimed is:

1. A method for installing a pivoting wall, the method comprising the steps of:

providing an opening in a fixed wall comprised of structural framing members, a first framing member of the fixed wall corresponding to the top of the opening, a second framing member of the fixed wall corresponding to the bottom of the opening;

providing a wall unit comprised of structural framing members, the wall unit being configured to fit within the opening of the fixed wall, a first framing member of the wall unit corresponding to the top of the wall unit, a second framing member of the wall unit corresponding to the bottom of the wall unit;

attaching a top bracket of a bottom bracket assembly to the second framing member of the wall unit, the top bracket including a first horizontal plate and a first pipe sleeve, the top of the first pipe sleeve being welded to the bottom center of the first horizontal plate, the bottom of the first pipe sleeve including a belled flange;

attaching a bottom bracket of a top bracket assembly to the first framing member of the wall unit, the bottom bracket including a second horizontal plate and a second pipe sleeve, the bottom of the second pipe sleeve being welded to the top center of the second horizontal plate;

placing a top bracket of the top bracket assembly on top of the bottom bracket of the top bracket assembly, the top bracket including a third horizontal plate and a third pipe sleeve, the top of the third pipe sleeve being welded to the bottom center of the third horizontal plate;

placing a bearing assembly on top of a bottom bracket of the bottom bracket assembly, the bottom bracket including a fourth horizontal plate and a fourth pipe sleeve, the bottom of the fourth pipe sleeve being welded to the top center of the fourth horizontal plate;

placing the bottom bracket of the bottom bracket assembly under the top bracket of the bottom bracket assembly such that the belled flange rests upon the bearing assembly;

placing the wall unit, including the top bracket assembly and the bottom bracket assembly, within the opening of the fixed wall;

attaching the top bracket of the top bracket assembly to the first framing member of the fixed wall; and attaching the bottom bracket of the bottom bracket assembly to the second framing member of the fixed wall.

2. A multi-component spin hardware for connecting structural framing members, said spin hardware comprising:

a top bracket assembly having a top bracket and bottom bracket, wherein the top bracket includes a flat horizontal plate and a pipe sleeve, wherein the top of the pipe sleeve is welded to the bottom center of the horizontal plate and the bottom of the pipe sleeve does not have a belled flange, and wherein the bottom bracket includes a flat horizontal plate and a pipe sleeve, wherein the bottom of the pipe sleeve is welded to the top center of the horizontal plate;

a bottom bracket assembly having a top bracket and bottom bracket, wherein the top bracket includes a flat horizontal plate and a pipe sleeve, wherein the top of the pipe sleeve is welded to the bottom center of the horizontal plate and the bottom of the pipe sleeve has a belled flange, and wherein the bottom bracket includes a flat horizontal plate and a pipe sleeve, wherein the bottom of the pipe sleeve is welded to the top center of the horizontal plate;

a counter bracket assembly having a horizontal tube and flat vertical plate, wherein one end of the horizontal tube is welded to the bottom center of the planar surface of the vertical plate;

means for pivotably connecting said top and bottom bracket assemblies within a fixed rigidly connected structural framing system for allowing selective displacement of a portion of said framing system to variable positions;

means for rigidly connecting multiple said counter bracket assemblies to structural framing system being selectively displaced;

said means for pivotably connecting said top and bottom bracket assemblies comprising a standard pre-manufactured bearing assembly for supporting the belled bottom flange of said top bracket of said bottom bracket assembly on a generally vertical axis for pivoting relative to the fixed rigidly connected structural framing system;

said top and bottom bracket assemblies connecting said structural framing system for pivoting on a vertical axis disposed to infinite positions relative to the fixed structural framing system.

3. The spin hardware of claim 1 wherein said bracket assemblies are comprised of high strength Grade A50 steel.

4. The spin hardware of claim 1 wherein said bracket assemblies are comprised of at least one high strength weldable metal.

5. The spin hardware of claim 1 wherein said vertical pipe sleeve of said bottom bracket of said bottom bracket assembly has an outer diametric size slightly smaller than the said standard pre-manufactured bearing assembly.

6. The spin hardware of claim 1 wherein said standard pre-manufactured bearing assembly has an outer diametric size less than the width of said flat horizontal plate of said bottom bracket of said bottom bracket assembly.

7. The spin hardware of claim 1 wherein said bracket assemblies are comprised of horizontal plates, vertical pipe sleeves, vertical plates, horizontal tubes, and a standard pre-manufactured bearing assembly.

8. The spin hardware of claim 7 wherein said horizontal plates, vertical pipe sleeves, vertical plates, horizontal tubes, and standard pre-manufactured bearing assembly are manufactured in a plurality of sizes configured to support increased dead and live loads.

9. The spin hardware of claim 1 wherein said top bracket of said bottom bracket assembly has gusset plates configured to support dead and live loads over 750 pounds.

10. The spin hardware of claim 1 wherein said bracket assemblies connects to said structural framing system, wherein said structural framing system is comprised of standard dimensioned wood lumber.

11. The spin hardware of claim 10 wherein said structural framing system is comprised of a wood material.

12. The spin hardware of claim 10 wherein said structural framing system is comprised of standard cold formed metal framing.

13. The spin hardware of claim 10 wherein said structural framing system is comprised of at least one metal material.

14. A pivoting wall system, comprising:

a fixed wall comprised of structural framing members in a fixed arrangement, the fixed wall including an opening, a first framing member of the fixed wall corresponding to the top of the opening, a second framing member of the fixed wall corresponding to the bottom of the opening;

a pivoting wall comprised of structural framing members, the pivoting wall being disposed in the opening of the fixed wall and configured to rotate relative to the fixed wall on a vertical axis using a top bracket assembly and a bottom bracket assembly, a first framing member of the pivoting wall corresponding to the top of the pivoting wall, a second framing member of the pivoting wall corresponding to the bottom of the pivoting wall;

the top bracket assembly having a first top bracket and a first bottom bracket, the first top bracket including a first horizontal plate and a first pipe sleeve, the top of the first pipe sleeve being welded to the bottom center of the first horizontal plate, the first bottom bracket including a second horizontal plate and a second pipe sleeve, the bottom of the second pipe sleeve being welded to the top center of the second horizontal plate;

the bottom bracket assembly having a second top bracket, a bearing assembly, and a second bottom bracket, the second top bracket including a third horizontal plate and a third pipe sleeve, the top of the third pipe sleeve being welded to the bottom center of the third horizontal plate, the bottom of the third pipe sleeve including a belled flange, the second bottom bracket including a fourth horizontal plate and a fourth pipe sleeve, the bottom of the fourth pipe sleeve being welded to the top center of the fourth horizontal plate; and wherein the first top bracket is rigidly connected to the first framing member of the fixed wall, the first bottom bracket is rigidly connected to the first framing member of the pivoting wall, the second top bracket is rigidly connected to the second framing member of the pivoting wall, the second bottom bracket is rigidly connected to the second framing member of the fixed wall, the bearing assembly is placed over the fourth pipe sleeve, and the belled flange rests upon the bearing assembly.

15. The pivoting wall system of claim 14, wherein the top bracket assembly and the bottom bracket assembly are horizontally centered relative to the opening of the fixed wall.

16. The pivoting wall system of claim 14, wherein the top bracket assembly and the bottom bracket assembly are horizontally centered relative to the pivoting wall.

17. The pivoting wall system of claim 14, wherein the first pipe sleeve, the second pipe sleeve, the third pipe sleeve, and the fourth pipe sleeve are disposed on the vertical axis of rotation.

18. The pivoting wall system of claim 14, wherein the top bracket assembly does not include a pipe sleeve having a belled flange and does not include a bearing assembly.

19. The pivoting wall system of claim 14, further comprising a plurality of counter bracket assemblies, each counter bracket assembly having a respective horizontal tube and a respective vertical plate, one end of the respective horizontal tube being welded to a first planar surface of the respective vertical plate, a second planar surface of the respective vertical plate being rigidly connected to a framing member of the pivoting wall.

20. The pivoting wall system of claim 19, further comprising a countertop supported by and rigidly attached to the horizontal tubes of the counter bracket assemblies.

* * * * *